United States Patent [19]

Morgan et al.

[11] 4,042,974

[45] Aug. 23, 1977

[54] HELMET FACE GUARD ACCESSORY FOR MOTORCYCLE RIDERS

[75] Inventors: Clyde R. Morgan, Boring; David C. Blocksom, Portland, both of Oreg.

[73] Assignee: Wheelsport Distributing Co., Portland, Oreg.

[21] Appl. No.: 622,392

[22] Filed: Oct. 14, 1975

[51] Int. Cl.[2] ..... A41D 13/00

[52] U.S. Cl. ..... 2/9; 2/424

[58] Field of Search ..... 2/9, 10, 173, 6, 5, 2/206, 424

[56] References Cited

U.S. PATENT DOCUMENTS

| | | | |
|---|---|---|---|
| 817,075 | 4/1906 | Lavis | 2/9 X |
| 3,152,588 | 10/1964 | Rogowski | 2/9 X |
| 3,293,660 | 12/1966 | Macklin | 2/9 |
| 3,298,031 | 1/1967 | Morgan | 2/9 |
| 3,787,895 | 1/1974 | Belvedere | 2/9 |
| 3,886,596 | 6/1975 | Franklin et al. | 2/9 |
| 3,889,296 | 6/1975 | Martin | 2/9 |

FOREIGN PATENT DOCUMENTS

| | | | |
|---|---|---|---|
| 860,527 | 7/1949 | Germany | 2/9 |

*Primary Examiner*—Werner H. Schroeder
*Assistant Examiner*—Peter Nerbun
*Attorney, Agent, or Firm*—Chernoff & Vilhauer

[57] ABSTRACT

A face guard accessory adapted to be attached to a motorcycler's helmet for protecting and shielding the nose, mouth and lower portions of the face from rocks, dirt and other flying debris encountered in riding. The face guard includes a shield portion removably attached to the helmet by a pair of side members slidably inserted in respective anchor clamps which are rigidly fastened to the exterior of the helmet. The anchor clamps are provided with respective threaded fasteners which engage the slidable side members and enable the user readily to attach and remove the shield portion and adjust its degree of forward extension as desired. Vent openings are provided in the shield portion of small enough dimension to prevent the entry of gravel, rocks and similar gross flying particles while permitting the passage of air. A foam insert pad is cemented to the inside of the shield portion covering the vent openings to act as a fine particle filter to prevent those smaller particles which do pass through the vent openings from being inspired into the nasal and oral cavities of the user.

6 Claims, 8 Drawing Figures

HELMET FACE GUARD ACCESSORY FOR MOTORCYCLE RIDERS

BACKGROUND OF THE INVENTION

This invention relates to a face guard accessory for a motorcycle rider's helmet for shielding the nose, mouth and lower portions of the face from flying debris of both large and small size while permitting free breathing. More particularly the invention relates to such a face guard of easily adjustable and removable structure.

In some forms of motorcycle riding, particularly in off-road or cross-country competition or recreational riding and even on paved roads where good maintenance is lacking, the rider experiences sprays of rock, dirt, foliage, dust and similar particles directed at his face, many times propelled at high velocity by the wheels of other motorcycles or vehicles in front of him. While goggles adequately protect his eyes from such debris, the lower portion of his face, primarily the lower nose, mouth and chin areas, are normally exposed to such hazards because the rider's need for sufficient air passage to the nose and mouth also provides a path by which the debris can gain access to the lower face area. This exposure sometimes causes facial injuries where the debris is of relatively large size such as gravel and strikes with relatively high velocity. A substantially lesser hazard, but still a nuisance, is the clogging of the nasal and oral cavities with fine debris such as dust or grit.

While face guards of many different types have in the past been developed for protecting persons from various hazards, none has previously been developed which is of sufficient technical, convenient and reliable design to offer a motorcycle rider adequate protection from the foregoing hazard of facial injuries caused by flying debris of substantial size and velocity. For example athletic face guards of the type shown for example in Bednarczuk U.S. Pat. No. 3,815,152 and Sowle U.S. Pat. No. 2,908,911, while adequate for their intended purpose of shielding the lower portion of the face from blows, are totally inadequate to shield the nose and mouth of a motorcycle rider from airborne particles of either gross or fine size. On the other hand, face masks of the type shown in Rogowski U.S. Pat. No. 3,152,588 or Langdon U.S. Pat. No. 3,276,445, while providing nose and mouth protection from fine airborne particles, would be inadequate to shield the lower portion of the face from flying particles of larger size such as gravel, twigs and rocks which, when impelled with high velocity against the face mask, would easily puncture the filtering material employed.

In addition, previous types of face guards or masks are either not adaptable to fit on helmets or, if adaptable, are either too easily dislodgeable and pop off the helmet during use, or are too difficult to remove or adjust with respect to the helmet. Difficult removal presents a problem with this type of guard because of the necessity to remove the guard frequently from the helmet. In order for the guard to be able to perform its protective functions adequately it must be placed reasonably close to the face, which however may require its removal or adjustment in order to remove the helmet from the user's head. Moreover the degree of closeness must be easily adjustable to enable the wearer to breathe comfortably under varying riding conditions.

Accordingly a need exists for a face guard of the type described which will satisfy the needs of a motorcycle rider with respect to protection particularly from the foregoing hazard of facial injury while still providing comfortable breathing and easy adjustability and removability.

SUMMARY OF THE PRESENT INVENTION

The present invention is directed to a face guard accessory adapted to be mounted on a motorcycler's helmet to protect the lower portion of his face, particularly his mouth and the lower portion of his nose, and preferably also his chin and cheeks, from the hazard of flying gross particles. The guard may also perform the secondary function of protecting his oral and nasal passages from fine airborne debris. The guard comprises a perforated concave-convex shield portion of impact-resistant, substantially rigid material of a size and shape sufficient to cover the protected facial areas and having multiple vent openings therein of a size sufficient to allow the passage of air but insufficient to allow the passage of gross particles such as gravel, rocks and twigs. Preferably polypropylene or other synthetic plastic is used because of its adaptability to injection molding, adequate strength-to-weight ratio, and water resistance which helps protect the wearer also from rain. An air-filter material, such as open-cell foam, which permits the passage of air but not the passage of fine particles such as fine dirt, dust or grit may be attached to the inner concave side of the perforated shield in a position covering the vent openings. The shield is rigidly extended in front of the face of the wearer by a pair of elongate side members which attach adjustably and removably to the sides of a helmet. Ideally the shield portion and side members are of unitary construction forming a streamlined, single piece of arcuate shape so as to minimize wind resistance and cause obstacles or flying particles to glance off easily. In order to provide high resistance against the impact of large or high velocity debris while minimizing the weight of the face guard apparatus, the shield and side members are preferably of a ribbed construction. Each side member is longitudinally slotted so as to fit slidably into the channels of respective right and left-hand anchor clamps which fasten rigidly to the exterior of the helmet such that the respective channels are substantially horizontal. Each anchor clamp is provided with a respective threaded fastener which extends through the slot in a respective side member and, when loosened, allows the side member to slide back and forth in a horizontal direction for adjustability of the shield portion or, if desired, to be removed from the anchor clamp entirely by virtue of the fact that the slot is open-ended. When tightened, the fastener frictionally engages the side member and, in cooperation with the clamp channel, rigidly fastens it to the helmet.

It is accordingly a primary objective of the present invention to provide a helmet-mounted face guard which performs the purpose of effectively protecting the lower face area from the hazard of high-impact particles while also permitting comfortable breathing.

It is a further objective of the invention to provide such a shield of lightweight, yet high-impact-resistant, construction which is easily adjustable with respect to horizontal extension forwardly of the wearer's face and is easily removable from the helmet.

It is a further objective to provide such face guard with the additional capability of filtering fine dust or grit and thereby preventing such material from entering the nasal and oral cavities of the wearer.

The foregoing and other objectives, features and advantages of the present invention will be more readily understood upon consideration of the following detailed description of the invention taken in conjunction with the accompany drawings.

DESCRIPTION OF THE PREFERRED EMBODIMENT

Figure 1:
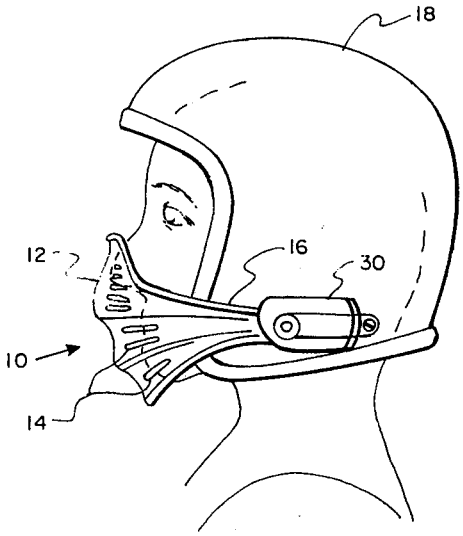
FIG. 1 is a side view of the preferred embodiment of the face guard assembly shown mounted on a helmet and worn by a motorcycle rider in operative position.
Figure 2:
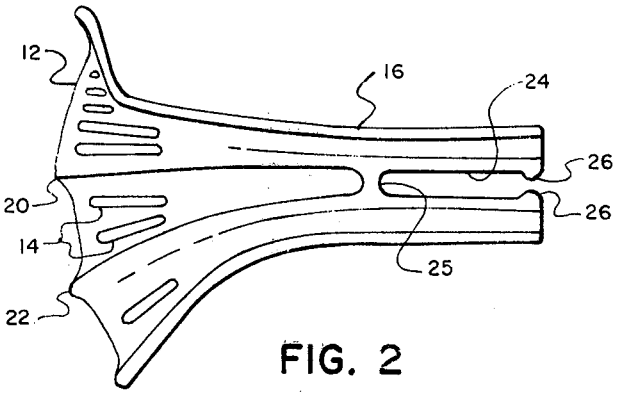
FIG. 2 is a side view of the perforated shield and side member portion of the face guard assembly.
Figure 4:
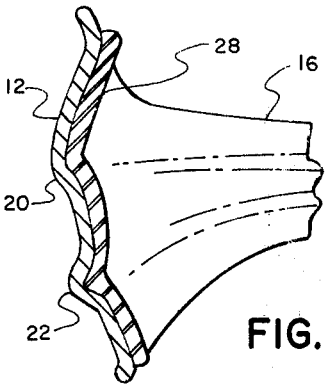
FIG. 4 is a cross-section of the shield portion taken along lines 4—4 of FIG. 3.
Figure 3:
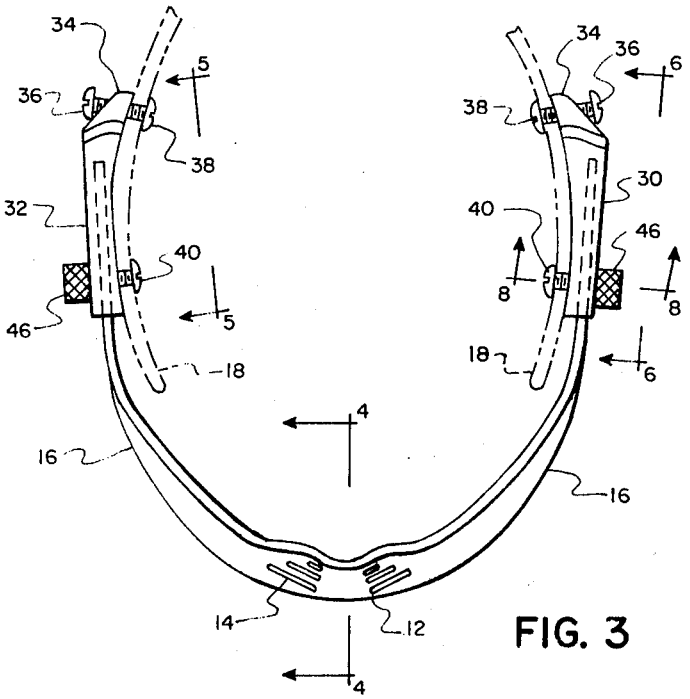
FIG. 3 is a top view of the face guard assembly as mounted on a helmet.
Figure 7:
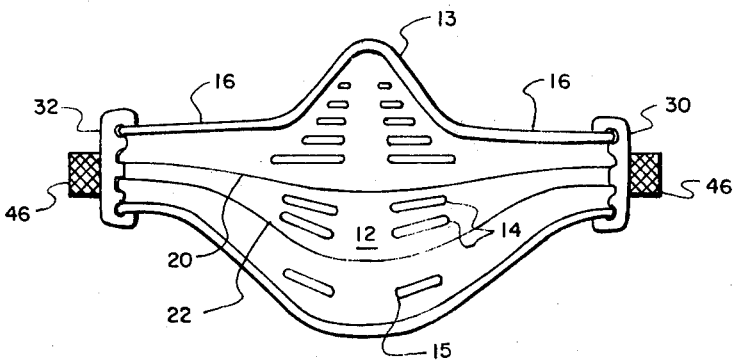
FIG. 7 is a front view of the face guard assembly.

The face guard assembly 10 as seen in FIG. 1 comprises a perforated shield portion 12 having a plurality of vent openings 14 formed therein as elongate slits of a narrow enough dimension to prevent the passage of gross airborne debris larger than about one-eighth inch in thickness. A sufficient number of vent openings are provided to insure adequate and comfortable access to breathing air through the openings. Preferably the width of the slit-shaped vent openings is between about one-sixteeth and about one-eighth of an inch. As best seen in FIG. 4, the shield portion 12 has a generally concave inner surface and convex outer surface, and includes a protruding upper nose guard portion 13 and lower chin guard portion 15 as shown in FIG. 7 to cover at least the lower portion of the nose and preferably the front of the chin. The material from which the shield is made is preferably molded high-impact-resistant polypropylene plastic or similar lightweight, rigid or semi-rigid material. A pair of elongate side members 16, preferably of unitary construction with the shield portion 12, extend from either side of the shield portion curving rearwardly about either side of the helmet 18 to form a streamlined arcuate piece as shown in FIG. 3. As seen in FIGS. 2, 4 and 7, both the shield portion 12 and side members 16 have convex-concave ridges 20 and 22 respectively formed therein for added rigidity and resistance to impact.

With reference to FIG. 2, each side member 16 has an elongate slot 24 formed longitudinally in the rear end thereof with a pair of cammed protrusions 26 formed in the upper and lower edges thereof at the rear of the slot. The purpose of the slot 24 and the protrusions 26 will be explained hereafter.

An air filter material 28 (FIG. 4), which may comprise an open cellular foam or other material suitable for permitting the free passage of air but blocking or entraining fine particles of dust or grit which are too small to be prevented from entering through the vent openings 14, is preferably attached by adhesive or otherwise to the inner surface of the shield portion 12 so as to cover the vent openings 14. If such filter material is used, it should conform to the interior of the shield 12 shown in FIG. 4.

Figure 6:
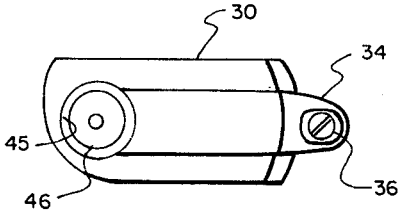
FIG. 6 is an outside view of the left-hand anchor clamp taken along lines 6—6 of FIG. 3.
Figure 5:
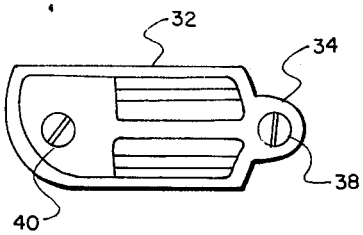
FIG. 5 is an inside view of the right-hand anchor clamp taken along lines 5—5 of FIG. 3.
Figure 8:
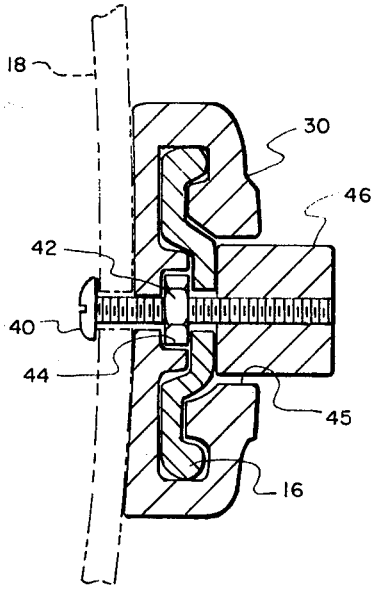
FIG. 8 is a sectional view of the right-hand anchor plate and right-hand side member taken along lines 8—8 of FIG. 3.

A pair of anchoring clamps 30, 32 provide the means by which the shield portion and side members are secured to the helmet 18. By their cooperation with the side members 16, the clamps also provide rapid and easy adjustability and removability of the shield 12. With reference to FIGS. 3, 5 and 6, each anchoring clamp includes a flange 34 at its rear end having an aperture formed therein large enough to permit the threaded body of a screw 36 to fit loosely therethrough and small enough to prevent the passage of the head of the screw. A mating screw-headed female socket 38 is provided which, when fitted from inside the helmet through a hole drilled through the base thereof for purposes of mounting the anchoring clamp, permits the screw 36 to be tightened so as to fasten the rear of the anchoring clamp to the exterior of the helmet 18. The front of the anchoring clamp is fastened to the helmet 18 by means of another screw 40, as best seen in FIG. 8, which is passed through another hole drilled in the base of the helmet and tightened into a nut 42 which is fitted into a socket 44 performed to match the shape of the nut and thereby resist its turning. The threaded portion of the screw 40 extends through an opening 45 in the opposite side of the clamp where it mates with a manual tightening knob 46.

Each anchoring clamp has an upper and lower channel into which the upper and lower portions of the side member 16 on either side of the slot 24 may be slidably inserted, with the two sides of the slot 24 straddling the threaded portion of the screw 40. With the side member 16 thus inserted, the manual knob 46 may be tightened into secure frictional engagement with the sides of the slot 24, thereby holding the side member 16 in a rigid position in cooperation with the clamp channels.

The forward end 25 (FIG. 2) of each slot 24 serves as a stop which bears against the body of the screw 40 and thereby limits the rearward sliding motion of the side member 16 within the anchoring clamp. Each stop 25 is positioned so as to prevent contact between the shield portion 12 and the face of the wearer when the clamps 30, 32 are properly installed on the helmet. This has the important advantage of preventing the shield 12 from being pushed rearwardly by some unusually heavy blow into contact with the wearer's face, thereby injuring him. Each slot 24 is also provided with a pair of inward protrusions 26 having forward and rearward cammed surfaces which prevent the side members 16 from inadvertently sliding forwardly out of the anchoring clamps if the knob 46 should become loosened. The protrusions 26 act as detents, contacting the body of the screw 40 before complete withdrawal of the side members from the clamps and having an effective spring action due to the semi-rigid nature of the plastic material, which offers a degree of resistance to spreading of the protrusions. This resistance however may be overcome by the application of sufficient manual force when withdrawal of the side members is intentional.

The foregoing mounting structure provides the shield portion 12 with easy and rapid removablilty and adjustability in a forward and rearward horizontal direction. By simply loosening the knobs 46 on either side of the helmet, the shield 12 may be removed by withdrawing the side members 16 from the clamps 30, 32 with a forward motion. To replace the shield 12, the side members 16 are merely inserted into the clamps 30, 32 and the knobs 46 tightened. Adjustment of the degree of forward extension, which adjusts the spacing between the interior of the shield and the face of the wearer, is likewise accomplished by loosening the knobs 46 and sliding the side members 16 forwardly or rearwardly until the desired position is obtained.

The above-described mounting arrangement provides an extremely reliable means by which the shield 12 is rigidly affixed to the helmet during use with minimal danger of its becoming loose or detached under the shocks characteristic of cross-country motorcycle riding. Despite the solidarity of the connection, the ease of removing and adjusting the position of the shield 12 are maximized.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A face guard accessory adapted to be adjustably, removably and rigidly attached to a protective helmet for motorcycler's and the like for protecting and shielding the lower portions of the face of the user from airborne particles comprising:

a. a perforated shield portion of substantially rigid material having multiple apertures formed therein for covering the lower portion of the face of said user while permitting comfortable access to breathing air through said apertures;

b. a pair of elongate substantially rigid side members connected to said shield portion and extending rearwardly therefrom for supporting said shield portion, each said side member having a longitudinal slot formed therein having an open end at the rearmost end of said side member, said slot extending forwardly from said open end a predetermined distance;

c. a pair of anchoring clamps for fastening said side members to the respective sides of said helmet, each said clamp having mating means for slidably engaging a slotted end of a respective one of said side members and constraining the movement of said side member to rectilinear sliding movement in a predetermined direction with respect to said helmet and including an outwardly protruding threaded post positioned so as to extend through said slot when said respective side member is slidably engaged with said mating means; and d. a respective manually-tightenable threaded securing means attached to the outer end of each of said threaded posts for selectively rigidly fastening said side members to said clamps at any of a plurality of sliding positions by the tightening of said securing means into engagement with the portions of said side members located on either side of said slot when said side members are slidably engaged with said mating means and, by the loosening of said securing means, for releasing said side members to permit said sliding movement and removal of said side members from said mating means.

2. The accessory of claim 1 wherein each of said threaded posts includes inwardly protruding means integral with said post for fastening said respective anchoring clamp to said helmet.

3. The accessory of claim 1 wherein said portions of each of said elongate side members located on either side of said slot are constructed of a semirigid material subject to spreading upon the application of outward pressure from within said slot, said semirigid portions on the sides of each of said slots including a pair of opposed protrusion means at the rear end of said slot directed inwardly toward said slot and having cam-shaped surfaces for engaging said post for preventing said side members from being removed slidably from said mating means without spreading said semirigid portions apart.

4. The accessory of claim 1 wherein said mating means for slidably engaging said side members comprises means defining an elongate sleeve for matingly accepting the insertion of a respective one of said side members.

5. The accessory of claim 1 wherein said apertures in said perforated shield portion are of a size sufficiently small to prevent the passage of particles having a thickness greater than $\frac{1}{8}$ inch.

6. A face guard accessory adapted to be attached to a helmet for motorcyclers and the like for protecting the lower portion of the user's face from high impact airborne particles likely to cause facial injury without thereby impairing the breathing of said user, said accessory comprising:

a. a central shield portion having an upwardly-extending central protrusion for covering the lower portion of the nose of said user and a downwardly-extending central protrusion for covering the front of the chin of said user and having a generally concave front surface and a generally convex rear surface;

b. a pair of elongate side members connected to opposite sides of said central shield portion and extending rearwardly therefrom for mounting said shield portion on said helmet, each of said side members having a longitudinal slot formed therein having an open end at the rearmost end of said side member and extending forwardly from said open end a predetermined distance;

c. said shield portion and pair of side members being made of a unitary piece of substantially rigid material having a generally arcuate shape from the rearmost end of one side member to the rearmost end of the other and including a plurality of separate outwardly protruding strengthening ridges integrally formed therein, each said ridge extending longitudinally along said side members and laterally across the front of said shield portion and each being spaced from the top and bottom edges of said side members and from the top of said upwardly-extending protrusion and the bottom of said downwardly-extending protrusion respectively;

d. said substantially rigid material of said shield portion having means defining a plurality of apertures therein located centrally between the top of said upwardly-extending protrusion and the bottom of said downwardly-extending protrusion of a size for permitting the passage of air through said shield portion to the nose and mouth of said user while preventing the passage therethrough of particles having a thickness greater than $\frac{1}{8}$ inch;

e. means for fastening said side members to said protective helmet such that, when said helmet is worn by said user, said shield portion is projected by said side members a spaced distance in front of the user's face in a position covering the portion of said user's face extending from the lower portion of the nose downwardly to the front of the chin, said means for fastening said side members to said protective helmet comprising a pair of anchoring clamps adapted for attaching to said helmet, each said clamp having an elongate sleeve means for slidingly and matingly accepting the insertion of a respective one of said side members and constraining the movement of said side member to sliding movement in a predetermined direction with respect to said helmet, and a manually-tightenable securing means attached to each of said clamps and slidably engageable with a respective one of said longitudinal slots for selectively rigidly fastening said side member within said sleeve at any of a plurality of sliding positions and, by the loosening of said securing means, for releasing said side member to permit said sliding movement and removal of said side member from said sleeve by disengagement of said manually tightenable securing means from said side member through said open end of said slot.

* * * * *

UNITED STATES PATENT AND TRADEMARK OFFICE

CERTIFICATE OF CORRECTION

PATENT NO. : 4,042,974

DATED : August 23, 1977

INVENTOR(S) : Clyde R. Morgan and David C. Blocksom

It is certified that error appears in the above-identified patent and that said Letters Patent are hereby corrected as shown below:

| | | |
|---|---|---|
| Col. 4, | lines 1-2 | After "12" add the word --as--; |
| Col. 4, | line 23 | Change "performed" to --preformed--. |

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*